United States Patent [19]

Mahmud

[11] Patent Number: 4,823,958

[45] Date of Patent: Apr. 25, 1989

[54] SERVING TRAY

[76] Inventor: Khalid Mahmud, 6601 Southcrest Dr., Edina, Minn. 55435

[21] Appl. No.: 84,619

[22] Filed: Aug. 12, 1987

[51] Int. Cl.[4] ..... B65D 1/34

[52] U.S. Cl. ..... 206/561; 206/564; 206/217; 206/515; 220/23.8; 220/23.83

[58] Field of Search ..... 220/23.8, 23.83; 206/561, 564, 217, 515, 519

[56] References Cited

U.S. PATENT DOCUMENTS

| | | | |
|---|---|---|---|
| 28,693 | 6/1860 | Shirley | 220/23.8 |
| D. 45,254 | 2/1914 | Dalton | 220/23.8 |
| D. 104,363 | 5/1937 | Barth . | |
| D. 160,688 | 10/1950 | Brock | 220/23.83 |
| D. 211,532 | 6/1968 | Ashton | 220/23.83 |
| D. 221,883 | 9/1971 | Cash | 220/23.8 |
| 1,943,698 | 1/1934 | Schurmann | 220/23.8 |
| 2,056,943 | 10/1936 | Lehman | 220/23.83 |
| 2,101,401 | 12/1937 | Leppke | 220/23.83 |
| 2,107,381 | 2/1938 | Leppke | 220/23.83 |
| 2,427,697 | 9/1947 | Weidler . | |
| 2,920,804 | 1/1960 | Minton . | |
| 3,094,264 | 6/1963 | Petrone . | |
| 3,240,030 | 3/1966 | Peters et al. | 220/23.83 |
| 3,942,671 | 3/1976 | Florian | 220/23.8 |
| 3,955,672 | 5/1976 | Brundage . | |
| 4,351,164 | 9/1982 | Christiani | 220/23.83 |

*Primary Examiner*—Joseph M. Moy
*Attorney, Agent, or Firm*—James R. Haller

[57] ABSTRACT

A food and beverage serving device designed for one-handed use. The container comprises a beverage receptacle with a flange extending outwardly from the receptacle walls and having a generally horizontal upper surface for supporting food servings. A plurality of generally radial ribs extend between the flange and receptacle walls to define upwardly open food compartments. The ribs provide upward support to the flange and hold the receptacle within the flange opening.

13 Claims, 5 Drawing Sheets

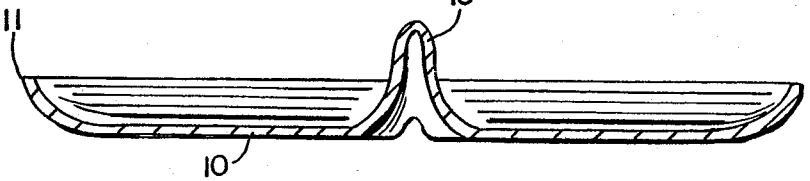
Fig. 5
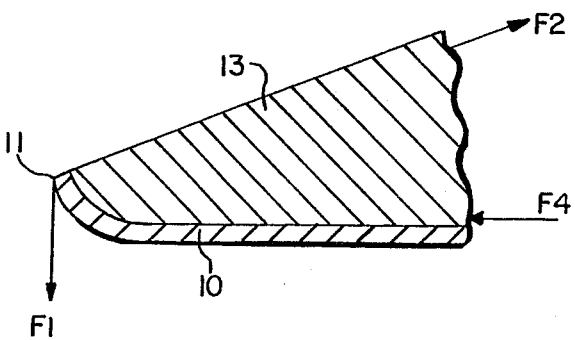
Fig. 6
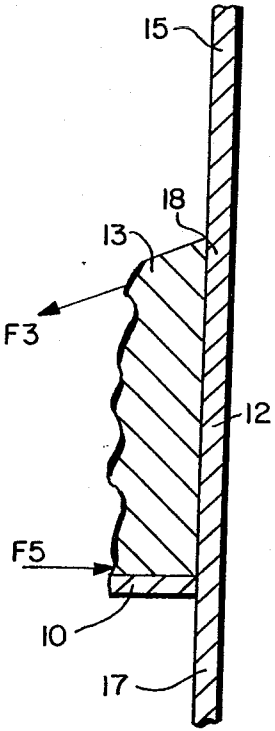

SERVING TRAY

FIELD OF THE INVENTION

The invention relates to an improved food and beverage container particularly adapted to be held in one hand.

BACKGROUND OF THE INVENTION

It is particularly desirable at times for a person to be able to hold a plate of food and a beverage cup in one hand, freeing the other hand for another activity. Guests at social events must attempt to balance a tray of food precariously on the top rim of beverage container in order to free a hand for another activity such as eating, gesturing, or greeting. In utilizing conventional serving means, it is generally necessary to locate a place upon which to set the beverage cup before one can consume the food with ease. Several attempts have been made to alleviate this problem. U.S. Pat. No. 2,920,804 discloses a non-compartmentalized serving plate and glass holder assembly made, of necessity, of rigid materials. A similar, generally triangular design is shown in U.S. Pat. No. Des. 211,532. U.S. Pat. No. 3,955,672 depicts a plate assembly with a channel formed in the lower surface of the assembly to receive the forearm of the user for support of the assembly.

DISCLOSURE OF THE INVENTION

The present invention provides a mutually supporting tray and drinking cup device particularly suitable for serving food and beverages at fairs, shopping centers, picnics, and other social gatherings. The device comprises an integral food and beverage container that can be stably supported by one hand and includes an upwardly open receptacle for liquids, the receptacle having side walls and a flange extending outwardly from the walls to provide a generally horizontal upper surface suitable for supporting food servings. The container includes ribs extending above the upper surface of the flange and between the flange and side walls to support the flange and to define, with the upper surface of the flange, a plurality of separate, food-receiving compartments.

BRIEF DESCRIPTION OF THE DRAWINGS

FIG. 5 is a cross-sectional view taken along line 5—5 of FIG. 1;

FIG. 6 is a diagrammatic representation of a portion of the container of FIG. 1, showing forces involved;

DETAILED DESCRIPTION OF THE PREFERRED EMBODIMENT

Figure 1:
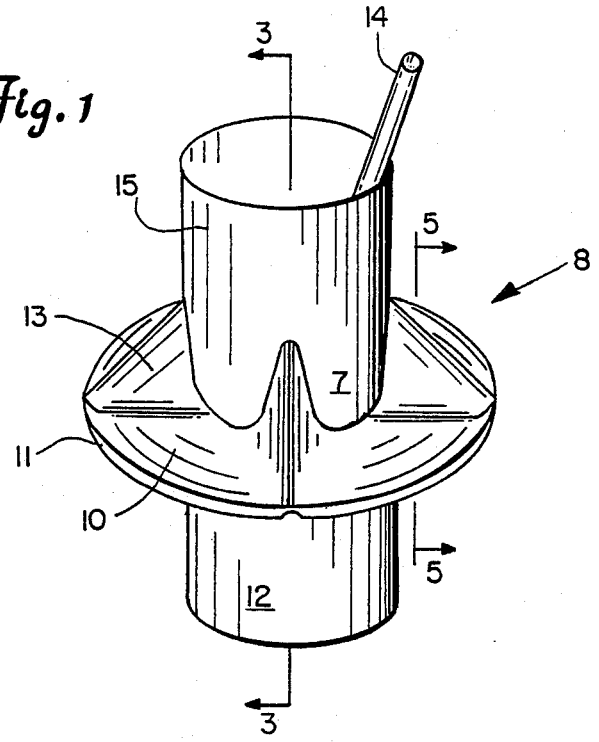
FIG. 1 is a perspective view of the container of the invention.

The container (8) of the invention preferably is formed as an integral piece but, for ease of understanding, the beverage receptacle and flange portions will be described as separate elements.

The container of the invention comprises an upwardly open receptacle (12) having outer walls (15). The receptacle (12) may be closed at its bottom to receive a beverage, or may have an open bottom so that the receptacle (12) may receive a separate cup containing a beverage.

Extending generally horizontally outwardly from the walls as an integral part thereof is a flange (10), the flange (10) desirably having a circular configuration and an outer, peripheral, upwardly turned rim (11). Although desirably circular in shape, as noted, the flange (10) may be formed with a generally rectangular, square or other configuration (viewed from the top), as may be aesthetically or functionally desired. The flange (10) includes a generally horizontal upper surface upon which food may be supported.

A plurality of angularly spaced ribs (13), at least two and preferably four or more in number, extend radially from the rim (11) of the flange (10) to the outer wall of the receptacle (12). Desirably, the ribs (13) are equiangularly spaced and are formed integrally with the flange (10), as by molding. They desirably exhibit an inverted V-shape in cross section, as shown in FIG. 5. Each rib (13) extends radially inwardly from the flange rim (11) to the outer wall of the receptacle (12). The ribs (13), when in contact with the receptacle (12), operate to hold the receptacle (12) and flange (10) together. The ribs (13) also join the outer rim (11) of the flange (10) to the receptacle (12), thus helping to support the weight of the food carried upon the flange (10). Through close contact with the beverage receptacle (12), the ribs (13) also support the beverage receptacle (12) to hold it in place and prevent it from falling through the opening (7) in the flange (10). The ribs (13), the outer wall of the receptacle (12), the upper surface of the flange (10), and the rim (11) define a plurality of separate, upwardly open food receiving compartments (9).

Although the ribs (13) have generally been shown as having an inverted "V" cross section, each rib providing support for adjacent sections of the flange, the ribs may take the form of single thickness, continuous or discontinuous webs of material.

The serving tray (8) thus described is not meant to be lifted to the lips. Liquid may be removed from the receptacle (12) using a drinking straw (14) or the like. In one embodiment, a drinking cup may be removably received in the receptacle which, in this embodiment, may have an open bottom through which the cup may protrude. The cup, which can be of paper or the like, may be removed from the receptacle and used for drinking. A straw may also be used, enabling the removable cup to remain inside of the receptacle during use.

Preferably, the serving tray container is molded or otherwise formed as an integral unit in a disposable or a non-disposable form from polystyrene, paper, plastic or other suitable material.

In a preferred embodiment as illustrated in FIG. 1, the walls of the receptacle (12) converge downwardly permitting the container to be easily formed through molding and readily nested with identical containers, providing efficient utilization of storage space.

When a food serving is received on the flange (10) of the invention, the ribs (13) support the flange (10) against sagging by exerting forces equal but opposite in direction to the forces exerted on the ribs (13) by the weight of the food serving. Referring to FIG. 6, the force (F1) exerted by the weight of the food acting on the flange is assumed for simplicity and ease of understanding, to act vertically downwardly on the rim (11) of the flange (10). In this loading condition, the upper portion of the rib (16) is in tension and the lower portion (15) of the rib is in compression. An outwardly directed force (F3) is applied to the upper receptacle portion (18) and an inwardly directed force (F5) is applied to the receptacle portion at the intersection of the rib (13), flange (10), and receptacle (12), by the flange (10) and rib (13) combination. These forces, F3 and F5, are opposed by forces F2 and F4 respectively, which are equal in magnitude but opposite in direction and are exerted by the receptacle (12) on the rib (13) and flange (10) combination in the same respective locations, that serve to keep the container in force equilibrium thus preventing the container from collapsing. The ribs (13) also exert force generally vertically upwardly on the adjacent flange (10) to oppose the generally vertically downwardly applied force of a food serving.

Figure 2:
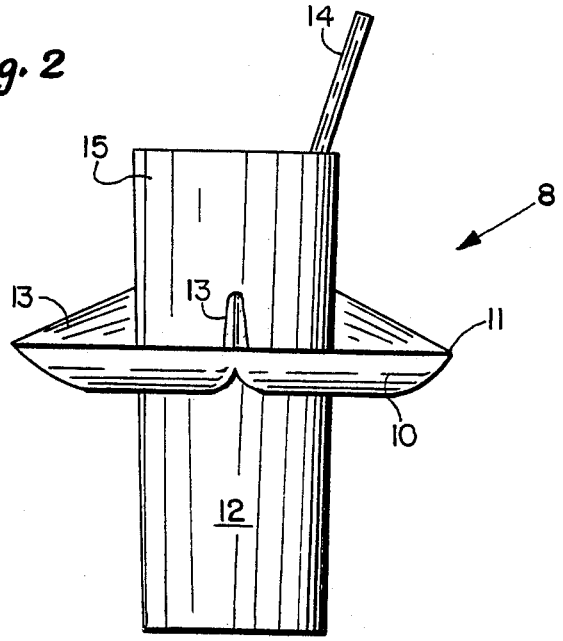
FIG. 2 is a side view of the container of FIG. 1.
Figure 3:
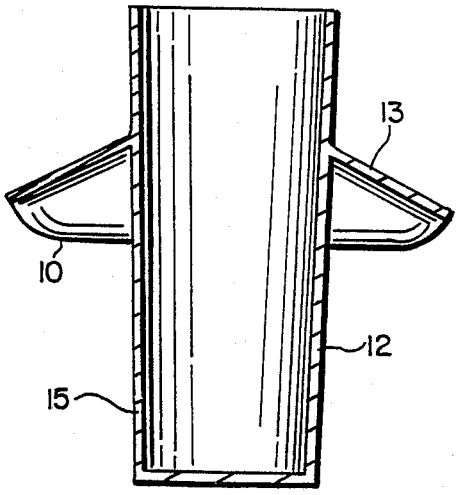
FIG. 3 is a cross-sectional view taken along line 3—3 of FIG. 1.
Figure 4:
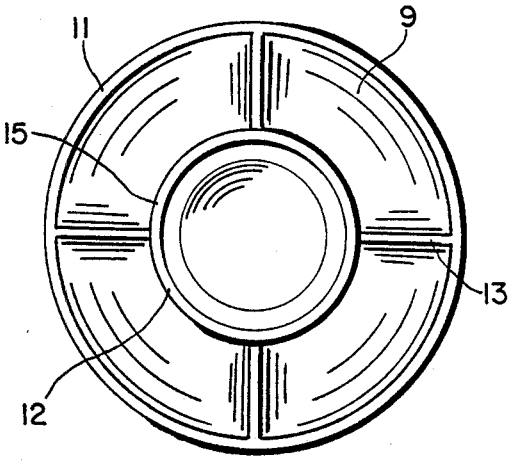
FIG. 4 is a top plan view of the container of FIG. 1.

By utilizing the general configuration shown in FIGS. 1 and 2, the assemblies of the invention can be nested together so that they can readily be stored in an orderly fashion.

Because of the support offered by the ribs (13) and the receptacle (12), the flange (10) may be made somewhat thinner and more flexible than plates previously used for picnics and the like, and I contemplate that the serving tray container may be made at a sufficiently low cost as to enable the container to be used once and then thrown away.

Figure 8:
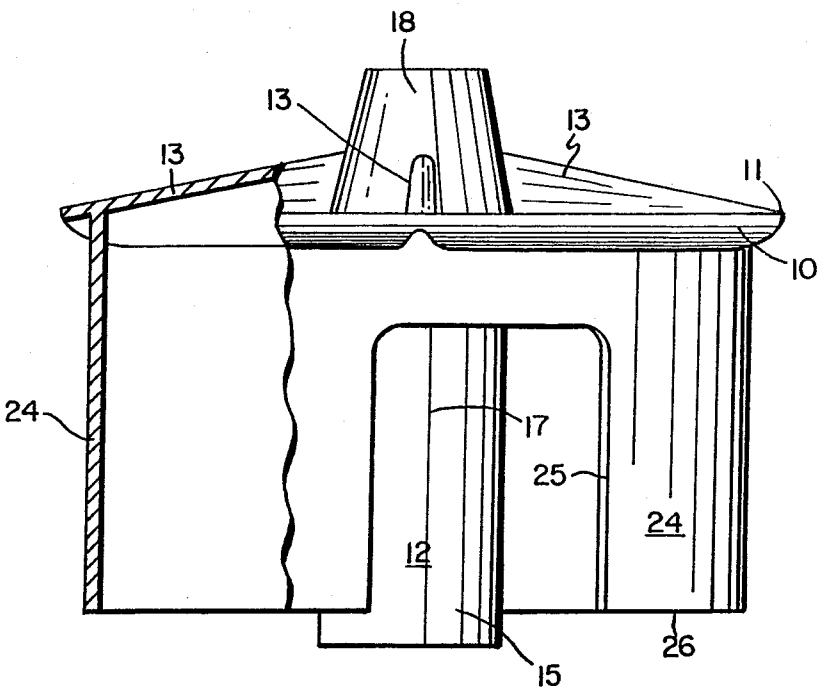
FIG. 8 is a side view in partial cross-section of another embodiment of the invention.
Figure 7:
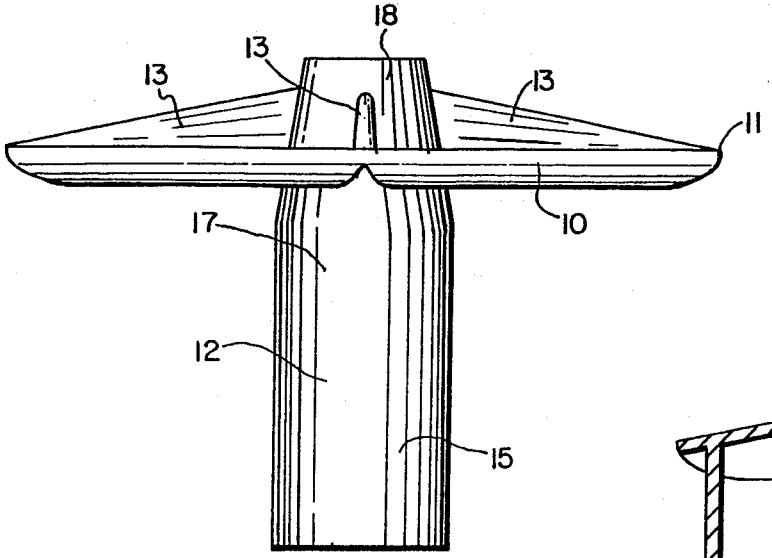
FIG. 7 is a side view of another embodiment of the invention.
Figure 9:
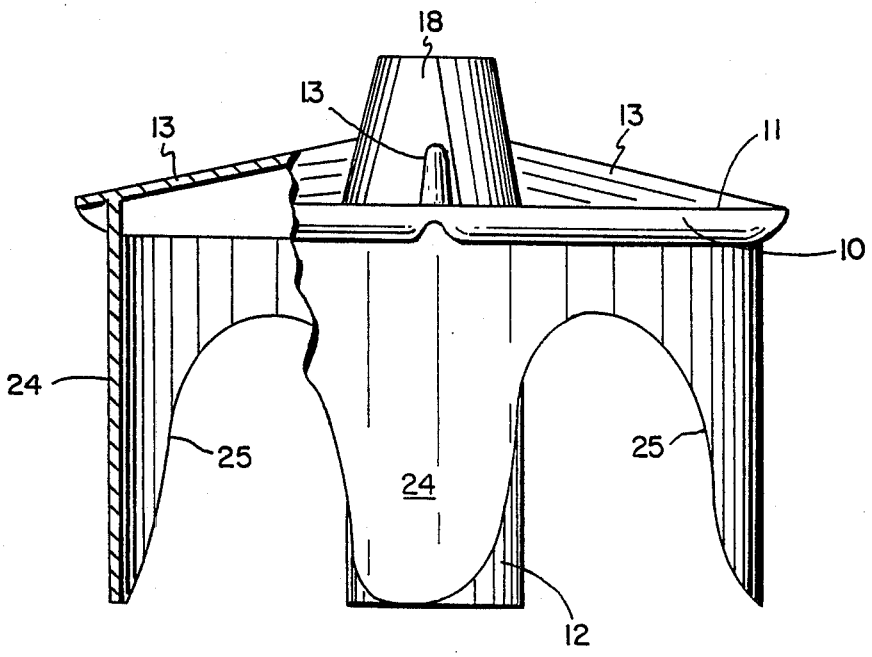
FIG. 9 is a side view in partial cross-section of another embodiment of the invention.

In another embodiment of the invention illustrated in FIG. 7, the portion of the receptacle (12) that protrudes upwardly above the upper surface of the flange (10) has walls that converge upwardly to restrain liquid in the receptacle from spilling into the flange. Also, a generally vertical, circumferential skirt (24) extends downwardly from the lower surface of the flange (10), at or adjacent its rim (11), the skirt having lower edges (26) which can be carried above, below, or in the same plane as the bottom surface of the receptacle (12). The skirt (24) adds support to the flange (10) by providing a stable base to contact surface upon which the container is placed, helping to prevent the container from toppling over. The skirt (24) may be unbroken throughout its periphery or one or more portions may be removed from it, as shown in FIGS. 8 and 9, to allow a hand to be received therethrough to grasp the receptacle (12).

Alternatively, a plurality of posts, preferably at least three in number, could be employed in place of the skirt (24) to add support to the flange (10) and help provide a stable base upon which the container may rest.

While a preferred embodiment of the invention has been described, it should be understood that various changes, adaptations and modifications may be made therein without departing from the spirit of the invention and the scope cf the appended claims.

What is claimed is:

1. A food and beverage serving tray container comprising:
   (a) an upright, upwardly open receptacle having side walls;
   (b) a flange extending outwardly from the side walls of the receptacle and providing a generally horizontal upper surface for supporting food servings;
   (c) a plurality of radially extending upward depressions in the bottom surface of the flange and a plurality of corresponding upward ridges arising from the upper surface of the flange and defining a plurality of angularly spaced ribs extending radially from the flange to the walls of the receptacle, the ribs providing mutual support between the flange and receptacle and defining, with the flange and receptacle, separate upwardly open food receiving compartments, the receptacle and flange being son configured and arranged as to nest with identical assemblies.

2. The serving tray device of claim 1 wherein the tray is formed as an integral unit.

3. The serving tray device of claim 1 wherein the ribs have an inverted, generally V-shape configuration in cross-section.

4. The serving tray device of claim 1 wherein the flange is circularly shaped and coaxial with the receptacle.

5. The serving tray device of claim 1 wherein the receptacle has upper and lower portions extending above and below the flange, respectively.

6. The serving tray of claim 4 wherein the receptacle walls converge downwardly below the flange.

7. The serving tray device of claim 4 wherein the outer walls of the receptacle converge upwardly above the flange.

8. The serving tray device of claim 1 wherein the receptacle has an open bottom, the device including a cup removably received in the receptacle.

9. The serving tray device of claim 1 wherein the receptacle protrudes sufficiently below the flange to enable it to be grasped from beneath by the hand.

10. The serving tray device of claim 1 including a generally vertical skirt protruding downwardly from the flange and spaced outwardly therefrom, the skirt having a lower rim oriented to contact a surface upon which the device is placed to stabilize the device.

11. The serving tray device of claim 10 wherein said skirt extends substantially continuously unbroken around the device, presenting a generally unbroken, circular lower rim.

12. The serving tray device of claim 10 wherein said skirt includes one or more openings therein to receive a hand therethrough enabling the device to be grasped.

13. The serving tray device of claim 10 wherein the skirt is comprised of one or more generally vertical posts.

* * * * *

UNITED STATES PATENT AND TRADEMARK OFFICE

CERTIFICATE OF CORRECTION

PATENT NO. : 4,823,958

DATED : April 25, 1989

INVENTOR(S) : Khalid Mahmud

It is certified that error appears in the above—identified patent and that said Letters Patent is hereby corrected as shown below:

Column 1, line 15, insert --a-- between "of" and "beverage".

Column 3, line 44, insert --a-- between "contact" and "surface".

Column 4, line 19, delete "son", and replace it with --so--.

Signed and Sealed this

Second Day of January, 1990

*Attest:*

JEFFREY M. SAMUELS

*Attesting Officer*

*Acting Commissioner of Patents and Trademarks*